US006893019B2

(12) United States Patent
Gaygen

(10) Patent No.: US 6,893,019 B2
(45) Date of Patent: May 17, 2005

(54) BETTING GAME USING ONE DIE OF ONE COLOR AND TWO DIE OF ANOTHER COLOR AND GIVING SPECIAL STATUS TO A ROLL OF ONE ON THE SINGLE DIE

(76) Inventor: Daniel E. Gaygen, 14 Ringwood Ct. W., Ithaca, NY (US) 14850

( * ) Notice: Subject to any disclaimer, the term of this patent is extended or adjusted under 35 U.S.C. 154(b) by 113 days.

(21) Appl. No.: 10/388,134

(22) Filed: Mar. 13, 2003

(65) Prior Publication Data

US 2004/0178575 A1 Sep. 16, 2004

(51) Int. Cl.[7] ..... A63F 3/06
(52) U.S. Cl. ..... 273/274; 273/146; 273/309
(58) Field of Search ..... 273/274, 146, 273/309

(56) References Cited

U.S. PATENT DOCUMENTS

| | | | | |
|---|---|---|---|---|
| 4,247,114 A | | 1/1981 | Carroll | |
| 4,334,685 A | | 6/1982 | Robbins et al. | |
| 4,635,938 A | | 1/1987 | Gray | |
| 5,308,081 A | * | 5/1994 | Bartle | 273/274 |
| 5,413,351 A | | 5/1995 | Franklin | |
| 5,542,671 A | | 8/1996 | Stewart | |
| 5,879,006 A | | 3/1999 | Bowling | |
| 6,176,489 B1 | * | 1/2001 | Astaneha | 273/274 |
| 6,209,874 B1 | | 4/2001 | Jones | |
| 6,234,482 B1 | | 5/2001 | Henderson | |
| 6,378,869 B1 | * | 4/2002 | Hedge et al. | 273/274 |

OTHER PUBLICATIONS

Gollehon, John Casino Games Gollehan Books Grand Rapids, MI.
Gollehon, John All About Craps Perigee Books NY, NY.
Silberstang, Edwin The Winner's Guide to Casino Gambling Signet Reference Books NY, NY p 168–245.

* cited by examiner

*Primary Examiner*—Benjamin Layno

(57) ABSTRACT

A casino-type table betting game using one die of one color, or otherwise singularly marked, and two matching dice of another color, or otherwise marked as a pair. Players make wagers on the outcome of a single roll of the three dice. Wagers are made by placing bet markers on various areas of a game board that define bet types. One group of wagers is on the outcome of the singular die. A second group of wagers is on the pair of dice. A third group of wagers is on the total of all three dice. When the outcome of the singular die is a predetermined number (e.g., 1), the house wins all bets on the game board regardless of the outcome of the other two dice.

1 Claim, 1 Drawing Sheet

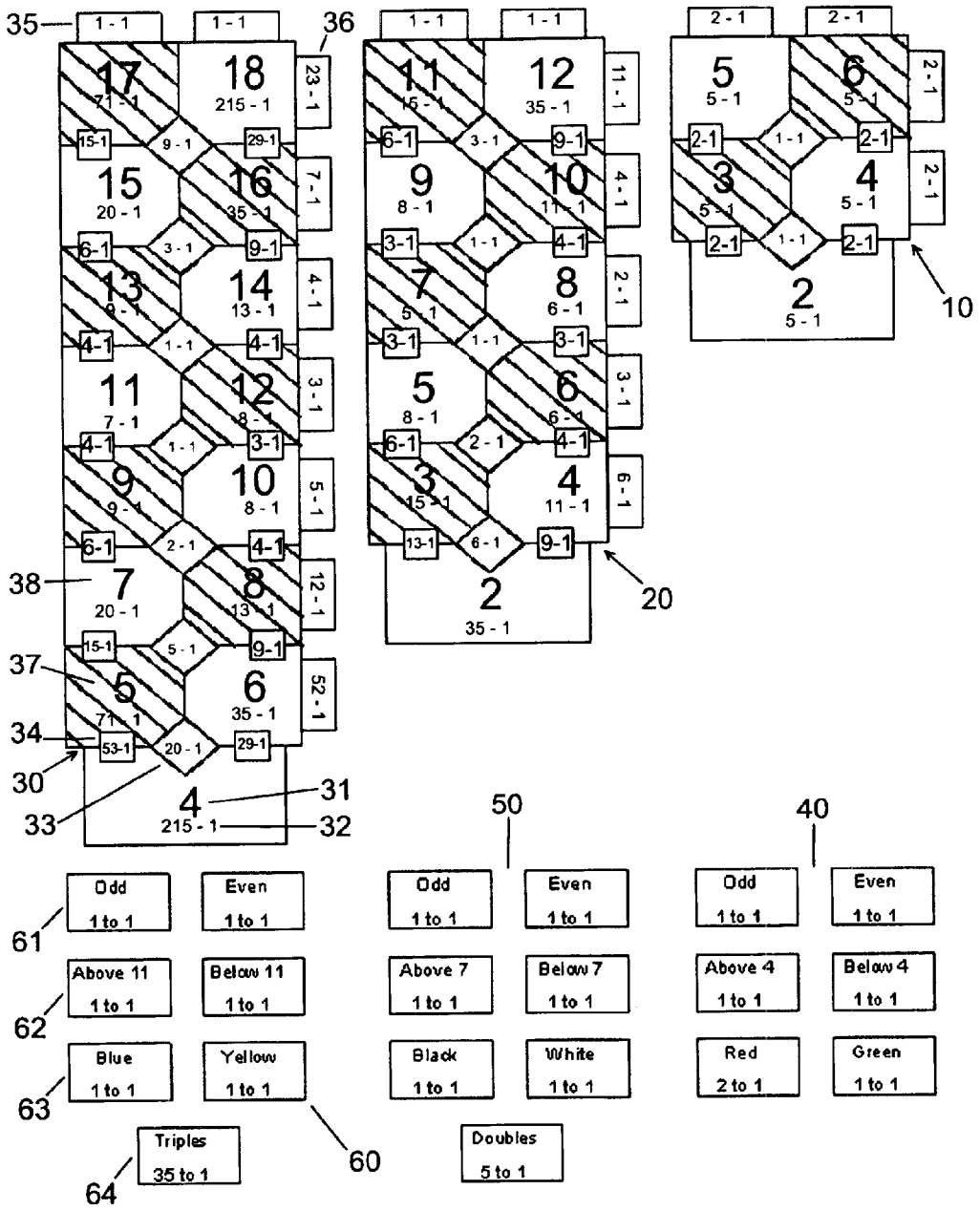
35
36
38
37
34
30
33
31
32
20
10
50
40
60
Odd 1 to 1
Even 1 to 1
Above 11 1 to 1
Below 11 1 to 1
Blue 1 to 1
Yellow 1 to 1
Triples 35 to 1
Odd 1 to 1
Even 1 to 1
Above 7 1 to 1
Below 7 1 to 1
Black 1 to 1
White 1 to 1
Doubles 5 to 1
Odd 1 to 1
Even 1 to 1
Above 4 1 to 1
Below 4 1 to 1
Red 2 to 1
Green 1 to 1
61
62
63
64

BETTING GAME USING ONE DIE OF ONE COLOR AND TWO DIE OF ANOTHER COLOR AND GIVING SPECIAL STATUS TO A ROLL OF ONE ON THE SINGLE DIE

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

1. Field of the Invention

This invention relates to games, specifically table games in which bets are placed on the outcome of dice rolls.

2. Discussion of Prior Art

Dice games have been used for gambling and entertainment for centuries. Dice games are well known in the art. Craps is probably the best-known dice gambling game. Craps is representative of multiple roll dice games in which some types of bets are not resolved for two, three, up to several rolls of the dice. Some types of bets in Craps are resolved on one roll. The biggest problem with Craps, from the point of view of the player, is that the rules are complex. Thus, it takes considerable study and/or playing to learn to play. This is also the major problem with Craps from the point of view of the game operator (e.g., the casino). The complexity of Craps intimidates some potential players who choose not to play and therefore lower the revenue of the casino.

Single roll dice games, such as U.S. Pat. No. 5,806,847 issued to White, et al. on Sep. 15, 1998 are inherently simpler than multiple roll games, such as Craps. However, they have fewer betting choices available to the players. Players lose interest more easily in a game that has relatively few betting choices.

Some games increase the number of possible bets by using three dice of the same color (e.g., U.S. Pat. No. 5,879,006 issued to James P. Bowling on Mar. 9, 1999). However, this game also involves multiple rolls for some types of bets and complex rules to be learned by the player. Thus, this game has the same problems as Craps.

Another three dice game is U.S. Pat. No. 6,209,874 issued to Paul Jones on Apr. 3, 2001. This game uses three dice, each a different color. The bets are resolved in one roll, which is simpler to learn than a multiple roll game. However, the use of three different color dice and bets involving the relative relationships of the outcome of the individual dice still results in a complex game that is likely to inhibit some potential players.

An additional problem with the games cited in the previous two paragraphs is that they specify payout odds that are considerably lower than natural odds for some bets. This is great for the game operator (e.g., the casino). However, players who are familiar with the computation of odds are likely to avoid such a game because the potential gain (i.e., the payout) is insufficient for the risk (i.e., the bet).

What is needed in the art is a dice game that provides players with a wide variety of bet types with a wide variety of payout odds and is simple to learn and play. Additionally, the game must provide the game operator (e.g., the casino) with a sufficient, predictable advantage that makes offering the game worthwhile. My game solves these problems.

BRIEF SUMMARY OF THE INVENTION

My game is a casino-type table betting game that is easy to learn and play. It provides several types of bets based on the outcome of a single roll of three standard dice (one of one color-a single die- and a pair of a different color), maximizing player choice and thus holding their interest. My game provides a wide variety of payout odds so that players can play within their chosen range of comfort regarding risk. The simplicity and amount of choice will attract many players that may be inhibited by other table games. My game provides the game operator with a predictable, considerable, fairly derived advantage, making it a profitable offering.

Accordingly, several objects and advantages of my invention are:

a. It is a simple game to learn. Simple observation of the playing are of the table and a few plays, or rolls of the dice, should be sufficient for newcomers to learn the procedure.

b. It is a simple game to play. Each bet is resolved with a single roll of the dice. Each play of the game involves only placing of bets on the playing surface, a roll of the dice, and a determination of winners and losers.

c. There is a wide variety of bets. Over one hundred different bets across six different areas on a playing surface may be placed.

d. There is a wide variety of payout odds. While game operators would be free to set their own payout odds, natural odds range from 1–1 at the low-risk end of the scale to 215 to 1 at the high-risk end of the scale with many intermediate levels.

e. Even using natural odds, a game operator has a considerable advantage because one possible outcome of the single die results in the game operator winning all bets, regardless of the outcome of the pair of dice or the total of all three dice.

f. The excitement value of the game is magnified because players can be taken to the very brink of winning, by choosing a bet on the pair of dice and/or the total of all three dice that matches the outcome of the roll, only to lose because of the outcome of the single die. As such, every player has a specific outcome or outcomes to root for (i.e., their bet or bets) on each roll. Simultaneously, every bettor has a common outcome to root against (i.e., a specified outcome of the single die that results in the house winning every and all bets for that roll).

Further objects and advantages of my invention will become apparent from a consideration of the drawings and ensuing description.

BRIEF DESCRIPTION OF THE SEVERAL VIEWS OF THE DRAWING

FIG. 1 is a top view drawing of the playing area of the table in the preferred method of my game. The dice are conventional and so do not have a figure and are not represented in FIG. 1.

REFERENCE NUMERALS IN DRAWING

10 betting area for the outcome of the single die
20 betting area for the outcome of the pair of dice

30 betting area for the outcome of all three dice
31 number representing the outcome of all three dice
32 payout odds for an individual dice outcome
33 betting area for a plurality of three dice outcomes
34 betting area for a pair of three dice outcomes
35 betting area for three dice outcomes, in a column
36 betting area for three dice outcomes in a row
37 blue background color for betting purposes
38 yellow background color for betting purposes
40 betting area with classifications of bets on one die
50 betting area with classifications of bets for two dice
60 betting area with classifications of bets for three dice
61 betting area for odd outcomes of three dice
62 betting area for outcomes of three dice above eleven
63 betting area for blue outcomes of three dice
64 betting area for outcome of all three dice being equal

DESCRIPTION OF THE INVENTION

Description of the Preferred Embodiment

My game is a casino-type table betting game. FIG. 1 shows the layout of the playing area. The playing area would typically be printed on felt affixed to the top of a gaming table with sides of sufficient height to contain a toss of dice on the table. For example, the layout could be fashioned to fit on a standard Craps table. However, it could be adjusted to fit on various other size tables. The layout shows the various bets that can be made on the outcome of a single toss of three standard dice. One of the dice is red and the other two are white.

There are six sections 10, 20, 30, 40, 50, 60 of the layout. Section 10 represents the possible bets on the outcome of the red die and its color scheme is red and green. Section 20 represents the possible bets on the outcome of the pair of white dice and its color scheme is black and white. Section 30 represents the possible bets on the outcome of all three dice and its color scheme is 37 blue and 38 yellow. Bets are placed by putting chips, markers, cash, or whatever is being risked inside the various betting areas of the section enclosed by lines. Winners and losers are determined by the outcome of a single roll of all three dice. The number of dots showing on the red die determines the winning bets in sections 10 and 40. The total of dots on the pair of white dice determines the winning bets in sections 20 and 50. The total number of dots on all three dice determines the winning bets in sections 30 and 60.

Each large square of sections 10, 20, 30 contains a number 31 that represents the outcome of the dice roll. For example, 31 represents the sum of all three dice totaling four. A bet on this square is a winning bet if the total of the three dice is four. In this situation, a bet on any other large square in section 30 is a losing bet.

Large squares in section 20 represent bets on the outcome of the pair of white dice. The determination of winning and losing bets in this section is the same as for section 30.

Large squares in section 10 represent bets on the outcome of the red die. The determination of winning and losing bets in this section is the same for sections 20, 30.

On any roll of the dice, when the outcome of the red die is one the house wins all bets. In this situation, the house even wins bets that would otherwise be considered winners in sections 20, 30, 40, 50, 60. For this reason, there is no large square representing one on the red die in section 10, even though a one occurs on the red die. It is also for this reason that no large square representing a total of three occurs in section 30 because a total of three for all three dice necessarily involves the red die outcome of one. This rule sets my game apart from prior art.

The rule described in the previous paragraph is also the reason that the house could offer natural odds for all available bets and still be assured of making a reasonable profit on the game. Game operators would be free to offer any payout odds they choose. However, offering natural odds assures a wide variety of risk to attract customers who seek a large payout as well as those who seek minimum risk. Of course, many factors affect the actual revenue of the game operator, but because the probability of the outcome of one on the red die is 1:6 the house will have a considerable advantage with my game.

The payout odds 32 for each large square bet in sections 10, 20, 30 are displayed below the number 31 that represents the total of the outcome of the die or dice. The payout odds are individually determined for each large square bet because some totals can be achieved by various combinations of outcomes of the dice (e.g., 7 in section 20, or 11 in section 30), while others can be achieved by only one outcome of the dice (e.g., 18 or 4 in section 30). This sets my game apart from other table games, such as roulette. In roulette, for example, the probability of winning a bet on any individual number is the same (i.e., 1 in however many slots occur on the wheel).

The small squares 34 that partially overlap two adjacent large squares in sections 10, 20, 30 represent bets either of those outcomes. For example, a bet on small square 34 is a bet that the three dice will total either four or five. The payout odds are displayed in the small squares. Again, the payout odds for these bets are determined individually because, just as for large square bets, some outcomes are more probable than others. This is also different from, for example, roulette where bets on two adjacent squares all have the same odds of winning.

The diamonds 33 that partially overlap four, or in some cases three, large squares in sections 10, 20, 30 represent bets on any of those outcomes. For example, a bet on diamond 33 is a bet that the total of all three dice will be either four or five or six. The payout odds are displayed in the diamonds and are determined individually for the same reasons that large and small square bets are determined individually.

Rectangles 35 at the top of columns of large squares represent bets on any of the outcomes in that column. For example, a bet on rectangle 35 is a bet that the total of the three dice will be five or seven or nine or eleven or thirteen or fifteen or seventeen. Note that for sections 10, 20, 30 the large square representing the lowest total for that section is not aligned with either column. So, for example, if the total of three dice is 4 then bets on either column topping rectangles in section 30 are losing bets. This method of reserving a number outside of both columns contributes to worthwhile profitability for the game operator while still providing players with a relatively high probability, low risk bet. The payout odds for column bets are displayed inside the rectangle.

Rectangles 36 adjacent to large squares along one column of sections 10, 20, 30 represent bets on either outcome in that row. For example, a bet on 36 is a bet that the total of all three dice will be seventeen or eighteen. Payout odds are displayed in the row bet rectangles and are determined individually for the same reasons as above.

Section 60 is a group of bets on the outcome of the total of all three dice. There are seven bets in this section arranged in three rows of two related bets and one row of one singular bet. A bet on rectangle 61 is a bet that the total of all three dice is an odd number. Players can also bet on the total being an even number. A bet on rectangle 62 is a bet that the total of all three dice is above eleven. Players can also bet that the total is below eleven. If the total is exactly eleven, then both above eleven and below eleven bets are losing bets. This method of reserving a total outside the parameters of the above and below bets contributes to worthwhile profitability for the game operator while still providing a relatively high probability, low risk bet for the players. A bet on rectangle 63 is a bet that the total of all three dice will equal a total of one of the large squares colored blue (i.e., five or eight or nine or twelve or thirteen or sixteen or seventeen). Players can also bet that the total of all three dice will equal a total of one of the large squares colored yellow (i.e., four or six or seven or ten or eleven or fourteen or fifteen or eighteen). A bet on rectangle 64 is a bet that the outcome of all three dice will be equal (i.e., all twos or all threes, etc.). Note that if all three dice come up one then the house wins all bets. The payout odds are displayed in the rectangles below the name of the bet.

Section 50 is a group of bets on the outcome of the pair of white dice. This group of bets is similar in character to the bets in section 60. Note that for this group the above/below target is seven. Note also that the color bets are black and white. Finally, note that the singular bet is doubles. This is a bet that the outcome of both white dice will be equal (i.e., both twos or both threes, etc). The payout odds are displayed in the rectangles below the name of the bet.

Section 40 is a group of bets on the outcome of the single red die. This group of bets is similar in character to the bets in sections 50 and 60. Note that the above/below target is 4. Note also that the color bets are red and green. Finally, note that there is no singular bet in this section. The payout odds are displayed in the rectangles below the name of the bet.

Each play of the game consists of three components. First, players place their bets as described above. Second, one of the players rolls all three dice. Third, winning and losing bets are determined by the outcome of the dice roll. The playing surface is cleared and the next play begins. The same player may continue to roll the dice until the outcome of one of the rolls includes a one on the red die. Then another player takes over rolling the dice. A player may relinquish the rolling of the dice before an outcome of one on the red die occurs if the player so wishes. If there is only one player that player may continue to roll even after an outcome of one on the red die. A person need not have placed a bet to take a turn rolling the dice. A person rolling the dice on consecutive plays of the game need not place a bet on every, or even any, of the plays of the game. However, game operators may wish to give priority to people placing bets when determining who rolls the dice. Allowing players to take turns rolling the dice adds excitement and involvement making the game more attractive to players.

Thus, the reader will see that my game is easy to learn, easy to play, is exciting and fun, offers a wide variety of bets, offers a wide variety of levels of risk, involves player interactivity, and is reasonably and fairly profitable to the game operator.

While the above description contains many specificities, these should not be construed as limitations on the scope of the invention, but rather as an exemplification of one preferred embodiment thereof. Many other variations are possible as will be seen in the next section. Accordingly, the scope of the invention should be determined not by the embodiments illustrated or described, but by the appended claims and their legal equivalents.

DESCRIPTION OF ALTERNATIVE EMBODIMENTS

There are several alternatives that could be chosen to modify my game both as a casino table game and as a game in other modalities of play. My game could be implemented as described above or with any or all additions, deletions, or substitutions described below, or others that do not change the process of the game, such as an electronic gaming machine. Such a machine could be played in a casino or any facility that provides gaming machines. My game could be adapted for play over computer networks such as intranets or the Internet. It could also be adapted for play over the World Wide Web. It could be adapted as computer software or software for play on electronic gaming consoles or appliances that are sometimes used to play games such as handheld computers or telephones. My game could be adapted as a board game. It could also be adapted for any and all technologies and channels not yet commonly available. It could be adapted for any and all technologies not yet patented, invented, or conceived of.

The various color schemes can be changed without changing the process of the game. The single die could be any color and the pair of dice could be any other color. The dice could be identified by means other than color such as an identifying mark on some or all of the faces of the dice that would indicate which die or dice correspond to which section of the playing surface. The color schemes of any or all of the sections of the game board could be changed without changing the process of the game. Contrasting color schemes such as would be used relative to a bet on 63 could be alternated relative to the preferred embodiment. In fact, any group of large squares, or alternatively shaped betting area, could be chosen for one or the other color in that sections color scheme. More colors could be added to a sections color scheme to add further betting opportunities to that, or any and all, sections. Contrasting colors need not be the indicators for bets such as 61. Stripes, dots, patterned backgrounds or any other indicator could serve the same purpose.

The shapes of the betting areas on the playing surface could be changed without changing the process of the game. For example, small squares indicating bets on adjacent pairs of large squares could be replaced with circles. Virtually any shape could be used in place of any of the shapes in the preferred embodiment.

The arrangement of the sections on the playing surface, relative to each other could be changed without changing the process of the game. For example, sections 10, 20, 30 could be aligned vertically, as could sections 40, 50, 60.

Instead of allowing players to roll the dice, the dice could be enclosed in a cage, or similar device, and operated by the game operator, the game operator's employee or agent. This would give the game operator increased security, but in exchange for lower player interactivity and involvement, which could result in less player interest.

The payout odds 32 could be deleted from the betting areas of the playing surface. The payout odds could be displayed separately as a chart or by any other means or not displayed at all.

The numbers representing the totals of a die or dice in sections 10, 20, 30 could be displayed in any type of numeral. They could also be represented by pictures of standard dice (i.e., what combinations of outcomes constitute a winner for a given section).

Betting areas could be added, either within large squares or alternative shapes or as separate betting areas, that specify outcomes on the various dice that constitute a winning bet for that large square. For example, such a bet, or sub bet, on the total of three dice equaling nine could specify what the outcome of the red die (or alternative) and the white dice (or alternative) must be to win the bet. This adds low probability, high risk bet types.

An additional bet could be added on the outcome of one on the red die. It could be added as part of section 10 or part of section 40 or as a separate section unto itself. This bet would essentially be betting against the shooter, or betting on the house. A bet on this section would be a winning bet if the outcome of the red die were one. However, all other bets would still be losing bets as described in the preferred embodiment. Adding such a bet would dilute the emotional impact of a red die outcome of one. It could lead to divisions and resentment among players. In the long run, it is likely that omitting this bet will be more beneficial to the game operator than including it. Along with an additional bet on the outcome of one of the red die, a further additional bet on the outcome of all three dice totaling three could be added. The drawbacks are similar to those described earlier in this paragraph.

I claim:

1. A method of playing a dice game having a dealer, who is an agent or employee of a game operator or house, and a plurality of players comprising the steps of:

a) providing one of said players with two dice of one color, or otherwise identified as a pair, and one die of another color, or otherwise identified as a singleton, or electronic or other representations thereof, said dice being hexahedral and each side of each die marked with a different indicia representing a number from one to six inclusive;

b) providing a game surface, or electronic or other representation thereof, having a betting area where said players make bets by placing a betting marker or markers, said betting area having one section for placing bets on the outcome of said single die including only outcomes 2, 3, 4, 5, and 6, one section for placing bets on the outcome of said pair of dice including outcomes 2, 3, 4, 5, 6, 7, 8, 9, 10, 11, and 12, one section for placing bets on the total of all three said dice including only outcomes 4, 5, 6, 7, 8, 9, 10, 11, 12, 13, 14, 15, 16, 17, and 18, one section for ancillary bets related to the outcome of said single die, one section for ancillary bets related to the outcome of said pair of dice, one section for ancillary bets related to the outcome of all three said dice, said game surface having no section for placing bets on said single die having an outcome of 1, wherein the dice game does not allow for the placing of bets on the single die outcome of 1;

c) providing payout odds for a winning bet for each bet on the game surface;

d) said players placing bets on said game surface;

e) said shooter rolling all three said dice together completing one play of said game;

f) said dealer determining winning bets by determining which bets match the outcome of the roll of the dice when the outcome of said single die is 2, 3, 4, 5, or 6;

g) said dealer taking possession of said betting markers on losing bets and paying said players making winning bets according to payout odds;

h) said dealer taking possession of any and all said betting markers anywhere on said game surface when the outcome of said single die is 1.

* * * * *